United States Patent [19]

Kress

[11] 4,381,639

[45] May 3, 1983

[54] SHEATH-CORE YARN FOR SEVERE THERMAL PROTECTING FABRICS AND METHOD THEREFOR

[75] Inventor: Robert R. Kress, Hatboro, Pa.

[73] Assignee: Record Industrial Company, King of Prussia, Pa.

[21] Appl. No.: 160,956

[22] Filed: Jun. 19, 1980

[51] Int. Cl.[3] ..... D02G 3/18; D02G 3/36; D02G 3/44

[52] U.S. Cl. ..... 57/229; 57/210; 57/904; 87/6

[58] Field of Search ..... 57/227, 207, 210, 6, 57/229, 904, 208; 87/1, 6; 428/364, 365, 388, 404

[56] References Cited

U.S. PATENT DOCUMENTS

| | | | |
|---|---|---|---|
| 3,572,397 | 3/1971 | Austin | 57/229 X |
| 3,729,920 | 5/1973 | Sayers et al. | 57/227 |
| 3,844,195 | 10/1974 | Rhodes et al. | 87/1 |
| 3,913,309 | 10/1975 | Chiarotto | 57/229 |
| 3,952,496 | 4/1976 | Nagel et al. | 57/207 |
| 4,015,038 | 3/1977 | Romanski et al. | 28/143 X |
| 4,074,512 | 2/1978 | Matt | 57/210 |
| 4,159,618 | 7/1979 | Sokaris | 57/904 X |
| 4,202,382 | 5/1980 | Westhead | 57/210 X |

*Primary Examiner*—John Petrakes
*Attorney, Agent, or Firm*—Ratner & Prestia

[57] ABSTRACT

A sheath-core yarn and methods of preparing it are disclosed. A sheath of aramid fibers surrounds a continuous filament core composed of an amorphous silica product containing at least 96% silica and having the thermal performance of a refractory material. The yarn is useful in woven or knitted safety garments which must provide protection under such severe conditions as splattering molten steel.

4 Claims, No Drawings

SHEATH-CORE YARN FOR SEVERE THERMAL PROTECTING FABRICS AND METHOD THEREFOR

BACKGROUND OF THE INVENTION

This invention relates to insulating fabrics which provide thermal protection of 2800° F. (1538° C.). The invention is more particularly concerned with sheath-core yarns, composed of synthetic fibers, which are useful in preparing safety garments.

U.S. Pat. No. 4,015,038, dated Mar. 29, 1977, discloses the use in dryer belts of yarns comprising textile fibers of polyethylene terephthalate or polyhexamethylene adipamide (nylon 6—6), braided over a core bundle of fiberglass (multiple glass fibers). After weaving into a belt, the yarns are coated with a resin composition capable of withstanding temperatures from about 100° F. to 300° F. without substantial degradation.

Safety garments have been prepared from yarns consisting of aramid fibers. As disclosed in DuPont NOMEX® aramid Bulletin N-236 dated October 1969, aramid fibers are similar to nylon 6—6 fibers in appearance and in resistance to flexing and abrasion. However, at 482° F. (250° C.), the melting point of nylon 6—6, these aramid fibers have a breaking strength equivalent to 60% of the value of room temperature. Aramid fibers do not melt but degradation begins to occur at temperatures above 700° F. (371° C.). KEVLAR® aramid fibers are similar to NOMEX® aramid fibers in the above respects; they are characterized by their remarkably high strength. KEVLAR® 29 aramid fibers have tensile strengths at 100° F. (38° C.) of over 20 gm/denier.

Industrial insulation has been prepared from continuous filaments of an amorphous silica product having the thermal performance of a refractory material. As disclosed in Hitco Product Data Bulletin "Engineering Data" dated October 1978, REFRASIL® textiles contain a minimum of 96% silica and a typical analysis is as follows:

| | | | |
|---|---|---|---|
| $SiO_2$ | 97.9% | $Fe_2O_3$ | 0.017% |
| $TiO_2$ | 0.55% | $ZrO_2$ | 0.017% |
| $Al_2O_3$ | 0.29% | SrO | 0.021% |
| MgO | 0.13% | CuO | trace |
| $B_2O_3$ | 0.41% | NiO | trace |
| CaO | 0.71% | $Cr_2O_3$ | trace |

The filaments will not melt or vaporize until temperatures exceed 3100° F. (1704° C.). Coatings have been used to improve their resistance to abrasion but further improvement is needed for use in safety garments.

SUMMARY OF THE INVENTION

The present invention is an improved yarn for use in safety garments to provide outstanding abrasion resistance and protection at high temperatures. The yarn has a sheath of aramid fibers surrounding a continuous filament core of an amorphous silica product containing at least 96% silica and having the thermal performance of a refractory material. The aramid fibers preferably include a substantial proportion having tensile strengths of at least 20 gm/denier. The fibers are preferably false-twist textured about the continuous filament core, but the fibers may be wrapped around the core with true twist or may be braided about the core. The aramid fibers preferably constitute about 30% to 50% of the total weight of the yarn. The usual proportion of aramid fibers to continuous filament core is about 40:60 by weight. The continuous filaments of the core usually contain about 98% silica.

DETAILED DESCRIPTION

The yarns of this invention may be prepared by conventional methods for covering a filament core with a sheath of textile fibers. For example, a roving of textile fibers is fed to each spinning position of a Saco-Lowell spinning frame, a filament core is added to each roving by feeding the core to the last drafting roll, and then fibers are wrapped around the core with true twist by ring spinning, using a No. 3 traveler and 6000 rpm. Another conventional method for preparing a sheath-core yarn uses a false-twist heat-setting process. A filament core is added to a yarn or roving of thermoplastic fibers, the combined yarn is passed over a heater to a false-twisting device, and the resulting false-twist textured yarn is wound up without added twist. The false-twisting device may be a rotating cylinder which develops twist by frictional contact with fibers on the surface of the yarn, or it may be a jet device which twists the fibers about the core with tangential air streams. The device backs up twist in the yarn to the heater and fibers are heat-set in curled configurations. Since the false-twist device also acts to remove twist as the yarn passes to the wind-up, the average net twist introduced is zero, but the fibers retain their heat-set configurations. The performance of the false-twist heat-set yarn in weaving or knitting may be improved by passing the yarn through an interlacing jet device just prior to wind up.

Safety garments woven from the yarns of this invention exhibit thermal protection up to remarkably high temperatures. Yarn prepared with 40% by weight of aramid fibers and 60% by weight of 0.020 inch diameter filament core of the REFRASIL® amorphous silica product described previously was woven into 18 oz./sq. yd. cloth. The cloth was stretched taught in a frame and molten steel at about 2800° F. (1538° C.) was poured on the fabric. The cloth remained unbroken even after the aramid fibers had been totally pyrolized. The performance of the cloth in this test was superior to that of 18 oz./sq. yd. cloth of the REFRASIL® amorphous silica product without any aramid fibers. Apparently there is a phenomena occurring with the physical properties, combustion environment, products of combustion and thermal performance of the aramid fibers and REFRASIL® product working together to produce such an excellent performance.

What is claimed is:

1. A yarn comprising a sheath spun from a roirng of aramid fibers surrounding a continuous filament core of an amorphous silica product containing at least 96% silica and having the thermal performance of a refractory material.

2. The yarn of claim 1 in which the aramid fibers include a substantial proportion having tensile strengths of at least 20 gm/denier.

3. The yarn of claim 1 in which the aramid fibers constitute about 30% to 50% of the total weight of the yarn.

4. The yarn of claim 1 in which the proportion of aramid fibers to continuous filament core is about 40:60 by weight.

* * * * *